US010946402B2

(12) United States Patent
Santagiuliana

(10) Patent No.: US 10,946,402 B2
(45) Date of Patent: Mar. 16, 2021

(54) DISPENSING DEVICE FOR DISPENSING LIQUIDS OR FLUIDS IN GENERAL

(71) Applicant: TAPLAST S.r.l., Dueville-Povolaro (IT)

(72) Inventor: Evans Santagiuliana, Vicenza (IT)

(73) Assignee: TAPLAST S.R.L.

( * ) Notice: Subject to any disclaimer, the term of this patent is extended or adjusted under 35 U.S.C. 154(b) by 0 days.

(21) Appl. No.: 16/710,699

(22) Filed: Dec. 11, 2019

(65) Prior Publication Data

US 2020/0171524 A1 Jun. 4, 2020

Related U.S. Application Data

(63) Continuation-in-part of application No. 16/065,081, filed as application No. PCT/IB2016/056679 on Nov. 7, 2016, now abandoned.

(30) Foreign Application Priority Data

Nov. 13, 2015 (IT) ..... 102015000072492

(51) Int. Cl.
*B05B 11/00* (2006.01)
*A47K 5/12* (2006.01)

(52) U.S. Cl.
CPC ..... *B05B 11/3021* (2013.01); *A47K 5/12* (2013.01)

(58) Field of Classification Search
CPC ..... B05B 11/0094; B05B 11/3023; B05B 11/3047; A47K 5/12; B65D 83/303
(Continued)

(56) References Cited

U.S. PATENT DOCUMENTS 3,111,245 A * 11/1963 Libit ..... B65D 47/305 222/534
3,655,103 A * 4/1972 Hazard ..... B65D 47/305 222/530

(Continued)

FOREIGN PATENT DOCUMENTS

| | | |
|---|---|---|
| CN | 20269753 | 1/2013 |
| JP | H1015023 | 1/1998 |
| WO | WO9726998 | 7/1997 |

OTHER PUBLICATIONS

European Patent Office, International Preliminary Report on Patentability for Application PCT/IB2016/056679, dated Oct. 27, 2017, 20 pp., International Searching Authority, EU.

(Continued)

*Primary Examiner* — Lien M Ngo
(74) *Attorney, Agent, or Firm* — McDonald Hopkins LLC

(57) ABSTRACT

The present invention concerns a dispensing device (100) for dispensing a liquid or fluid held in a container (C). The device (100) comprises: an engagement portion (101) for mutually engaging the device (100) and the container; drawing and dispensing means (102) suited to draw the fluid or liquid from the container (C) and then dispense it; a hollow operating cap (103) for operating the drawing and dispensing means (102); a dispensing nozzle or spout (104) provided with a dispensing duct (105) fixed to the operating cap (103). The dispensing nozzle or spout (104) can be switched through a rotary movement between a first dispensing position and a second non-dispensing position. The operating cap (103) and the dispensing nozzle or spout (104) are shaped in such a way as to respectively define a first stop surface (107) and a second stop surface (108); in the dispensing position the first and the second stop surfaces (107, 108) are arranged against each other.

4 Claims, 14 Drawing Sheets

(58) Field of Classification Search
USPC .... 222/530, 533, 517, 536, 535, 321.7–321, 222/9, 508, 153.03, 153.13; 220/709
See application file for complete search history.

(56) References Cited

U.S. PATENT DOCUMENTS

| | | | | | |
|---|---|---|---|---|---|
| 3,718,238 | A * | 2/1973 | Hazard | B65D 47/305 | 222/536 |
| 3,786,964 | A * | 1/1974 | Landen | B65D 47/305 | 222/153.14 |
| 3,873,005 | A | 3/1975 | Hazard | | |
| 3,874,562 | A | 4/1975 | Hazard | | |
| 3,884,392 | A | 5/1975 | Hazard | | |
| 3,907,174 | A * | 9/1975 | Steiman | B05B 11/3001 | 222/153.13 |
| 4,081,113 | A * | 3/1978 | Hazard | B65D 47/305 | 222/534 |
| 4,819,832 | A | 4/1989 | Lawson | | |
| 4,938,393 | A | 7/1990 | Ericson | | |
| 5,065,909 | A | 11/1991 | Pino | | |
| 5,615,809 | A | 4/1997 | Feer | | |
| 5,875,936 | A | 3/1999 | Turbett | | |
| 5,988,434 | A | 11/1999 | Keil | | |
| 6,390,341 | B1 * | 5/2002 | Ohmi | B65D 47/0809 | 222/182 |
| 6,715,649 | B2 | 4/2004 | Santagiulana | | |
| 9,393,583 | B2 | 7/2016 | Tu | | |
| 9,650,189 | B1 | 5/2017 | Lawson | | |
| 2015/0001257 | A1 | 1/2015 | Sell | | |

OTHER PUBLICATIONS

European Patent Office, International Search Report and Written Opinion for Application PCT/IB2016/056679, dated Feb. 13, 2017, 11 pp., International Searching Authority, EU.

* cited by examiner

D-D

G-G

K-K

DISPENSING DEVICE FOR DISPENSING LIQUIDS OR FLUIDS IN GENERAL

CROSS-REFERENCE TO RELATED APPLICATIONS

This application is a continuation of co-pending U.S. patent application Ser. No. 16/065,081, originally filed on Jun. 21, 2018 as a national stage application under 35 USC 371 claiming priority to international patent application no. PCT/IB2016/056679 filed on Nov. 7, 2016, which claims priority from Italian patent application no. 102015000072492 filed on Nov. 13, 2015, and are, therefore, incorporated by reference herein.

TECHNICAL FIELD OF THE INVENTION

The present invention concerns solutions for dispensing fluids or liquids. In particular, the present invention concerns solutions for dispensing fluids or liquids such as detergents, soaps, creams, for example for personal hygiene, washing hands etc. In greater detail, the present invention concerns a dispensing device for dispensing fluids or liquids of the type mentioned above. In even greater detail, the present invention concerns a dispensing device of the type suited to be coupled with a container holding the fluid or liquid to be dispensed, for example suited to be fixed to the neck of a container in the shape of a bottle or a similar shape.

DESCRIPTION OF THE STATE OF THE ART

Dispensing devices for dispensing liquids or fluids, for example liquid or fluid soaps for personal hygiene, are known in the art and widely marketed and used, said devices being, in fact, suited to allow liquids or fluids held in a container to be dispensed. Said devices in general comprise engagement means (for example, a threaded ring gear) suited to allow them to be applied or fixed to a container (for example, to the neck of a container in the shape of a bottle), drawing and dispensing means suited to draw the liquid or fluid from the container and successively dispense it towards the outside, as well as operating means suited to operate the drawing and dispensing means, and, finally, a nozzle or spout for actually dispensing the liquid or fluid.

When the dispensing device is applied to the container, for example, as explained above, screwed to the neck of the container, the drawing pipe of the drawing and dispensing means is at least partially immersed in the liquid or fluid to be dispensed, while the operating means and the dispensing nozzle are positioned outside the container itself. Exerting pressure, for example with the palm of the hand, on the operating means causes the fluid or liquid to flow upwards along the drawing means and to be dispensed towards the outside through the dispensing nozzle or spout.

In the simplest and most common dispensing devices, the dispensing nozzle, which is rigidly fixed to the operating means or even made in a single piece with the operating means, projects from the operating means themselves and thus constitutes a hindrance that considerably complicates the operations required to manage the device both when this is handled individually and when it is handled together with the container (applied to the container itself).

For example, the projecting nozzle or spout complicates the packaging operations considerably. Furthermore, the projecting nozzle constitutes a critical component, since it is subject to damage or even breakage, both during the packaging operations and successively during transport, shipment or handling in general.

In the attempt to at least partially overcome the drawbacks summed up above, dispensing devices were proposed in the recent past, which were provided with a dispensing nozzle or spout suited to be switched between a non-dispensing position and a dispensing or use position, wherein in the non-dispensing position the nozzle or spout occupies a minimum space or in any case occupies less space than in the dispensing position. For example, devices were proposed in which, in the dispensing position, the dispensing nozzle or spout extends along a direction that is substantially perpendicular to the direction of extension of the drawing pipe (which corresponds to a direction substantially parallel to the underside of the container), while in the non-dispensing position the nozzle extends substantially parallel to the drawing pipe (and thus substantially along a vertical line with respect to the underside of the container).

Solutions were also proposed according to which, in the non-dispensing position, the nozzle or spout is housed within the projection of the container, if not even within the projection of the engagement means of the dispensing device.

However, the dispensing devices with switching nozzle or spout are not without drawbacks or inconveniences either.

For example, a first drawback or inconvenience is related to the instability of the nozzle or spout, both in the dispensing and in the non-dispensing position, with the risk, therefore, of it being undesirably switched between the two positions.

Furthermore, there is the risk of undesired leakages of fluid or liquid, due to the difficulties met in the attempt to guarantee tightness at the level of the mutual engagement portions of the dispensing nozzle or spout and of the operating cap, respectively.

A further drawback is also related to the difficulties met in the process of emptying the dispensing nozzle completely, wherein, therefore, when the nozzle is switched in the non-dispensing position undesired leakages of fluid or liquid cannot be avoided.

And again, a further drawback or inconvenience is related to the poor reliability of the mutual coupling or engagement between the dispensing nozzle or spout and the operating cap, with the consequent risk of the nozzle or spout undesirably coming off the operating cap.

Finally, a further drawback is related to the difficulties met in the process of producing and assembling the component parts, operations which in some cases are decidedly complicated and therefore excessively expensive.

Dispensing devices according to the state of the art are known from documents U.S. Pat. No. 3,874,562, WO 97/26998, U.S. Pat. No. 3,907,174, and JP H10 15023.

It is thus an object of the present invention to overcome the drawbacks described above and observed in the solutions known in the art.

In particular, the objects and aims of the present invention can be summed up as follows.

It is a first object of the present invention to provide a dispensing device for fluids or liquids of the type provided with a switching dispensing nozzle, which makes it possible to eliminate or at least minimize the risk of the nozzle itself accidentally coming off.

It is a further object of the present invention to provide a device of the type mentioned above that guarantees the reliable and stable positioning of the switching nozzle in both the dispensing and the non-dispensing position.

It is also one of the objects of the present invention to guarantee the tightness of the device, and thus to avoid fluid or liquid leakages, in particular at the level of the mutual coupling point between the dispensing nozzle and the operating cap.

Furthermore, it is one object of the present invention to provide a device of the type mentioned above in which the dispensing nozzle, in the non-dispensing position, is arranged in such a way as to occupy a minimal space, in particular in such a way as not to increase the space generally occupied by the device itself.

Furthermore, according to the present invention the dispensing nozzle, when in the dispensing position, must give a pleasant appearance and shape to the device.

It is also a further object of the present invention to provide a device of the above mentioned type in which the dispensing nozzle can be switched in a simple and immediate manner, and in which the component parts can be produced and assembled in an equally simple and immediate manner and thus at limited costs.

DESCRIPTION OF THE PRESENT INVENTION

The present invention derives from and is based on the general consideration according to which the drawbacks found in the devices carried out according to the known art can be eliminated or at least minimized by conveniently shaping and orienting the portions of the operating cap and of the dispensing nozzle, respectively, which when the dispensing nozzle is in the dispensing position are placed in mutual contact with each other and thus constitute the stop portions that define the end-of-stroke position of the dispensing nozzle or spout.

The present invention is also based on the further consideration according to which the risk of the dispensing nozzle accidentally coming off or becoming detached from the operating cap can be avoided or at least minimized by conveniently shaping the portions of the operating cap and of the dispensing nozzle or spout, respectively, by means of which the cap and the nozzle are mutually constrained in a switching manner.

Based on the considerations summed up above, the subject of the present invention is thus a dispensing device for dispensing a liquid or fluid held in a container, said device comprising an engagement portion for mutually engaging said device and said container with each other, drawing and dispensing means for drawing said fluid or liquid from said container and respectively dispensing it, an operating cap for operating said drawing and dispensing means through a pressure exerted thereon, and a dispensing nozzle or spout provided with a dispensing duct for dispensing said fluid or liquid and fixed to said operating cap, wherein said dispensing nozzle or spout can be switched through a rotary movement between a first dispensing position, in which said dispensing duct is in communication with the inside of said operating cap, and a second non-dispensing position, wherein said operating cap and said dispensing nozzle or spout are shaped in such a way as to respectively define a first stop surface and a second stop surface, wherein in said dispensing position said first stop surface and said second stop surface are arranged against each other, and wherein said second stop surface of said dispensing nozzle or spout lies on a plane crossed by the projection of said dispensing duct along its direction of extension.

According to a variant embodiment, said operating cap and said dispensing nozzle or spout are shaped in such a way as to furthermore define a third stop surface and a fourth stop surface, respectively, wherein in said dispensing position also said third stop surface and said fourth stop surface are arranged against each other.

According to a further variant embodiment, said third stop surface is substantially perpendicular to said first stop surface, and said fourth stop surface is substantially perpendicular to said second stop surface.

According to a further variant embodiment, said third stop surface extends from said first stop surface in such a way as to define a stop projection of said operating cap, wherein said fourth stop surface extends from said second stop surface in such a way as to define a stop seat of said dispensing nozzle or spout, and wherein with said dispensing nozzle or spout in said dispensing position said stop projection is housed in said stop seat.

Advantageously, said operating cap may comprise an upper operating surface suited to be pressed when said drawing and dispensing means are operated by exerting pressure on said cap, wherein with said dispensing nozzle or spout in said dispensing position said upper surface and said dispensing nozzle or spout define a substantially continuous surface.

Still advantageously, said dispensing nozzle or spout comprises a constraining portion in a predetermined shape housed in a constraining seat in a matching shape provided in said operating cap, wherein the external and internal surfaces respectively of said constraining portion and of said constraining seat are in mutual contact and can be translated with respect to each other.

According to a possible further variant embodiment, said constraining portion of said dispensing nozzle or spout has a substantially spherical or substantially cylindrical shape.

According to a possible further variant embodiment, said constraining portion comprises at least one first switching tab or tooth that extends from the external surface of said constraining portion, wherein said internal surface of said constraining seat defines at least one first switching seat or lowered part, and wherein with said dispensing nozzle or spout in said dispensing position said first switching tab or tooth and said first switching seat or lowered part are mutually engaged with each other in such a way as to prevent or at least hinder the spontaneous switching of said dispensing nozzle or spout from said first dispensing position to said second position.

Advantageously, said constraining portion comprises at least one second switching tab or tooth that extends from the external surface of said constraining portion, wherein said internal surface of said constraining seat defines at least one second switching seat or lowered part, and wherein with said dispensing nozzle or spout in said second non-dispensing position said second switching tab or tooth and said second switching seat or lowered part are mutually engaged with each other in such a way as to avoid or at least hinder the spontaneous switching of said dispensing nozzle or spout from said second non-dispensing position to said first dispensing position.

Still advantageously, said device comprises at least one constraining pin whose longitudinal extension axis coincides with the rotation axis of said dispensing nozzle or spout, and whose opposite ends are inserted in corresponding constraining housings created in either the constraining portion or the constraining seat.

According to one or more further possible variant embodiments, the opposite ends of said constraining pin extend from the external surface of said constraining portion and are inserted in corresponding constraining housings defined by the internal surface of said constraining seats, or the opposite ends of said constraining pin extend from the internal surface of said constraining seat and are inserted in constraining housings defined by the external surface of said constraining portion.

Advantageously, in said second non-dispensing position said dispensing nozzle or spout is housed in the space defined by the longitudinal projection of said engagement portion.

The subject of the present invention includes also a system for dispensing a fluid or liquid, said system comprising a container suited to contain said fluid or liquid and a dispensing device according to one or more of the variant embodiments summed up above and/or described here below.

Possible further embodiments of the dispensing device and/or system according to the present invention are defined in the claims.

The present invention can be conveniently applied to solutions for dispensing liquids or fluids for personal hygiene like, for example, soaps, creams, detergents or similar products. The applications of the present invention, on the other hand, are not limited to solutions for dispensing fluids or liquids for personal hygiene; on the contrary, the dispensing device according to the present invention can be used to dispense fluids or liquids of any type.

The present invention will be clarified in greater detail below through the description of some of its embodiments which are illustrated in the attached drawings, wherein.

Figure 12:
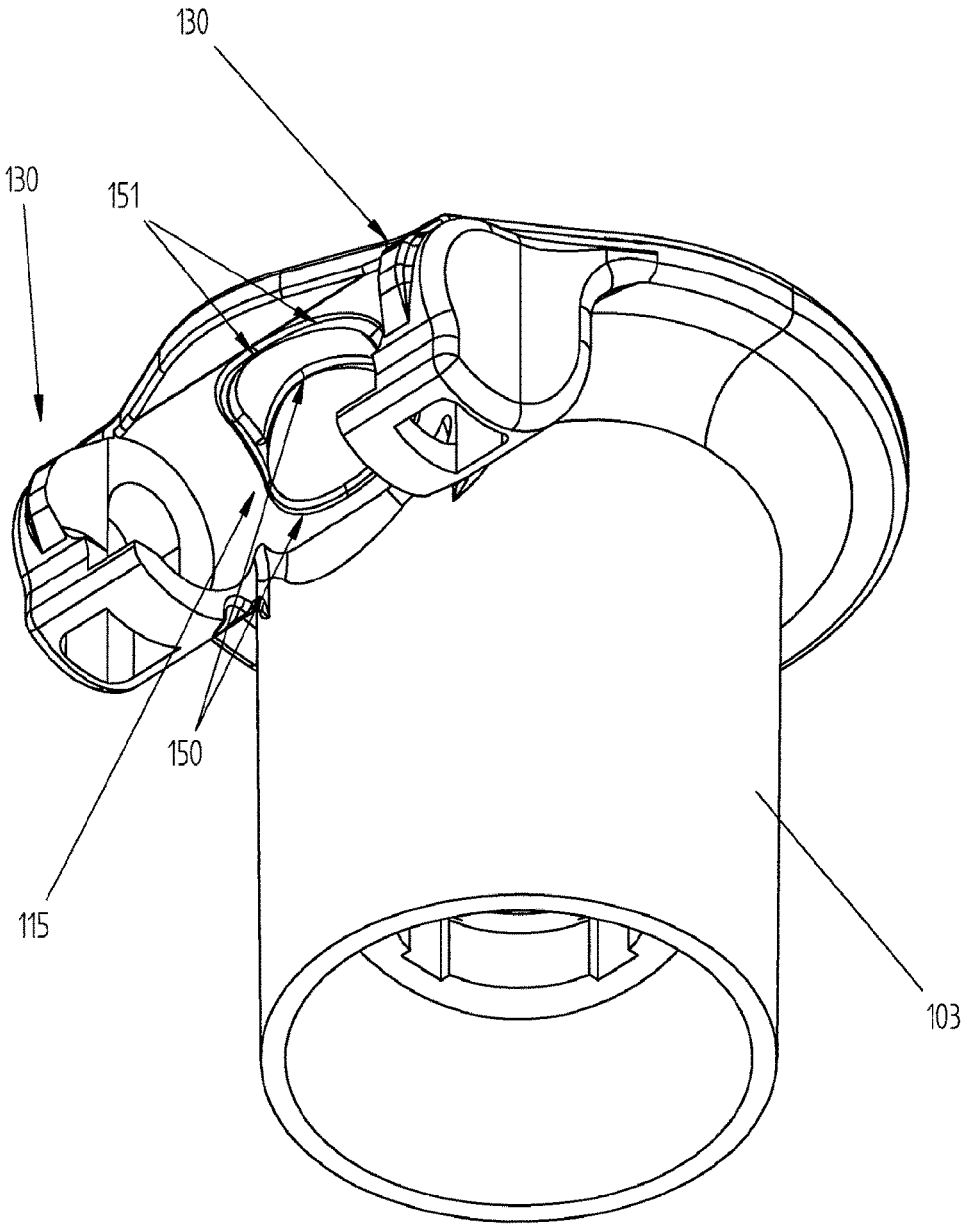
Figure 13:
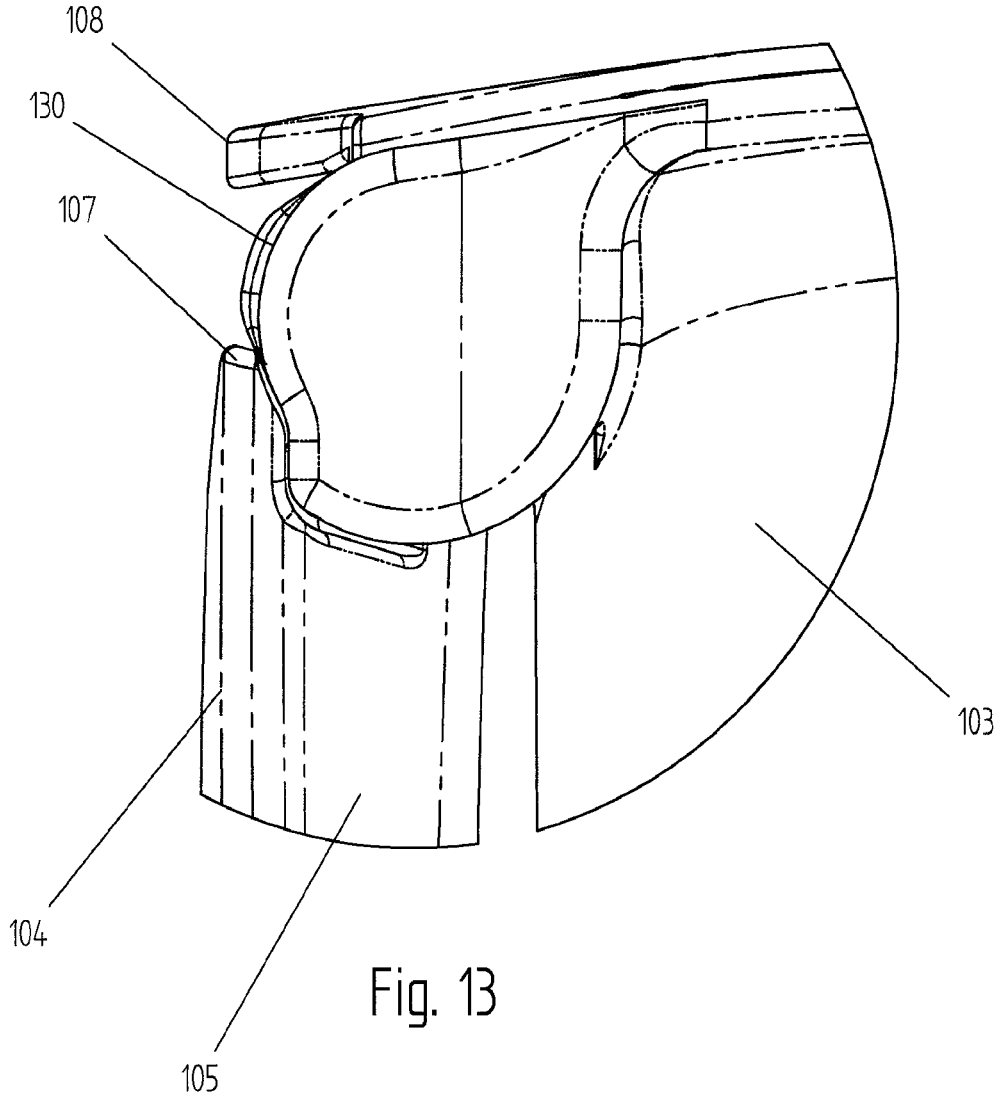
Figure 16:
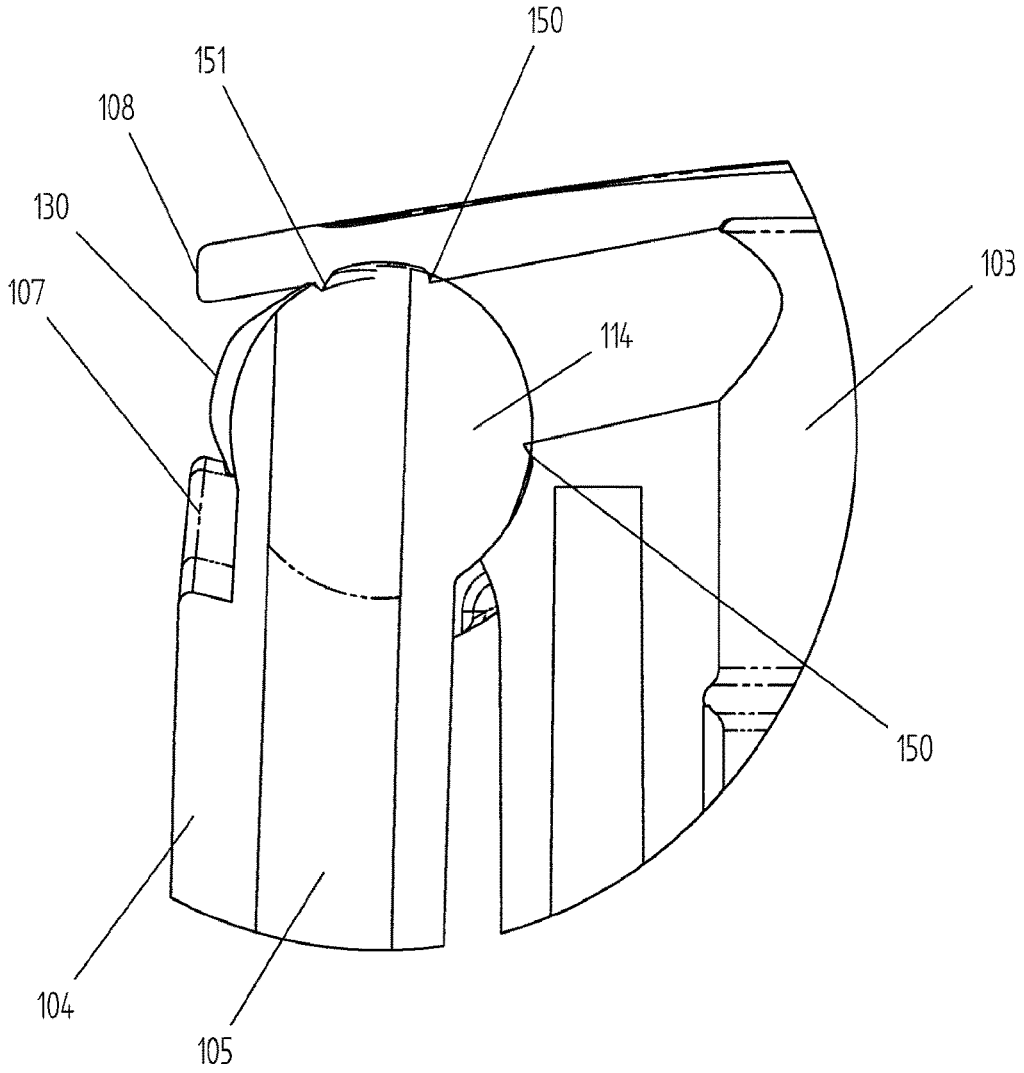
Figure 17:
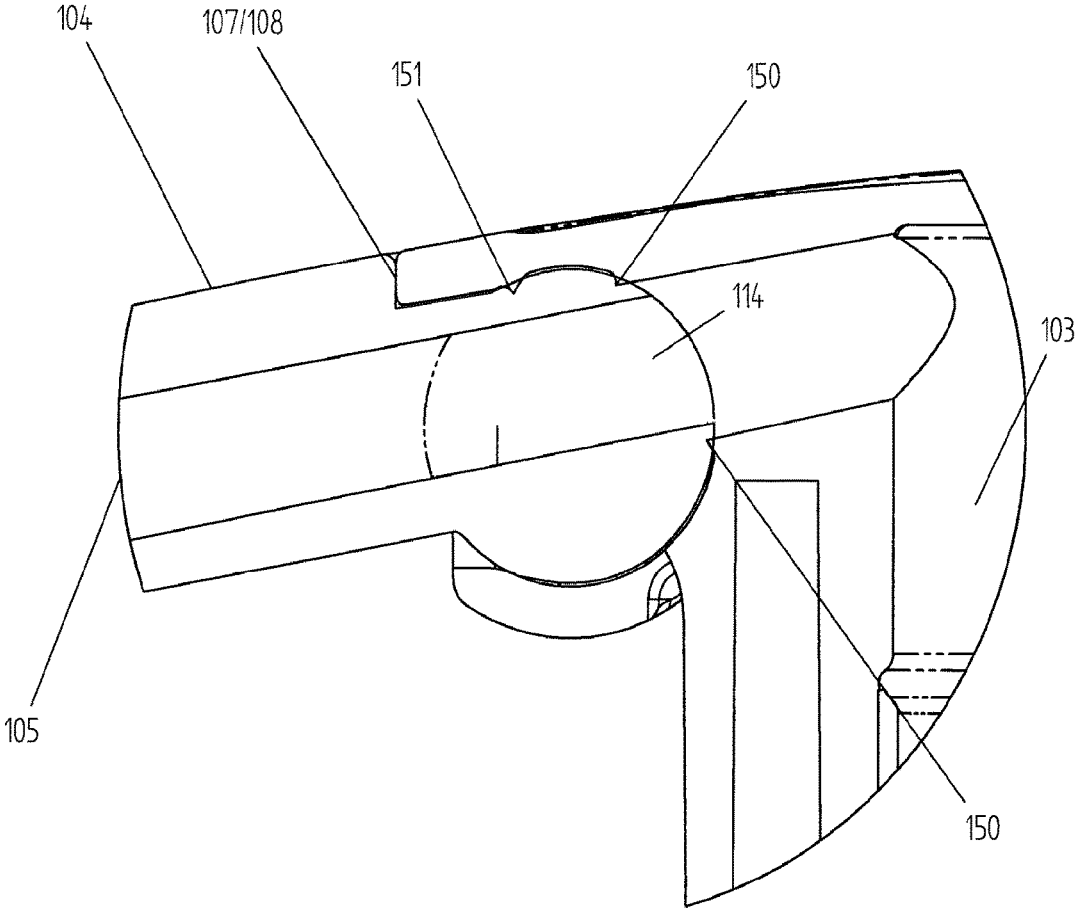

FIG. 12 and from 13 to 15 respectively show a perspective view and side sectional views of the device or of its component parts according to a further embodiment of the present invention;

FIGS. 16 and 17 show each a side sectional view of the dispensing device shown in FIG. 12.

DETAILED DESCRIPTION OF THE PRESENT INVENTION

Although the present invention is described below with reference to its embodiments illustrated in the drawings, the present invention is not limited to the embodiments illustrated in the drawings and described in detail below. On the contrary, all those variants of the embodiments illustrated in the drawings and described in detail below that are obvious for the expert in the art fall within the scope of the present invention.

In FIGS. 1 to 4 the dispensing device according to the embodiment represented therein is identified by the reference number 100 and essentially comprises an engagement portion 101, for example a threaded ring gear (FIG. 4), by means of which the device 100 can be fixed to a container, for example screwed to the neck of a container holding the fluid or liquid to be dispensed, drawing and dispensing means 102, as well as an operating cap 103 and finally a dispensing nozzle 104 suited to dispense the fluid or liquid towards the outside. In practice, imagining the device 100 applied to the neck of a container (not illustrated), it can be understood how exerting pressure, for example with the palm of the hand, on the operating cap as shown by the arrow in FIG. 2 causes the fluid or liquid to flow upwards along the suction pipe 100*a* (at least partially immersed in the fluid or liquid) of the drawing and dispensing means 102, and thus along the means 102 themselves, and also causes the fluid or liquid to be dispensed by the cap 103 towards the outside, in particular through the dispensing duct 105 of the nozzle 104. The operating modes of the drawing and dispensing means 102, in particular the manner in which the fluid or liquid flows upwards through the means 102 and successively flows out through the duct 105 of the nozzle 104 are not necessarily included in the objects of the present invention, and therefore the detailed description of the same is omitted for the sake of brevity.

Figure 1:
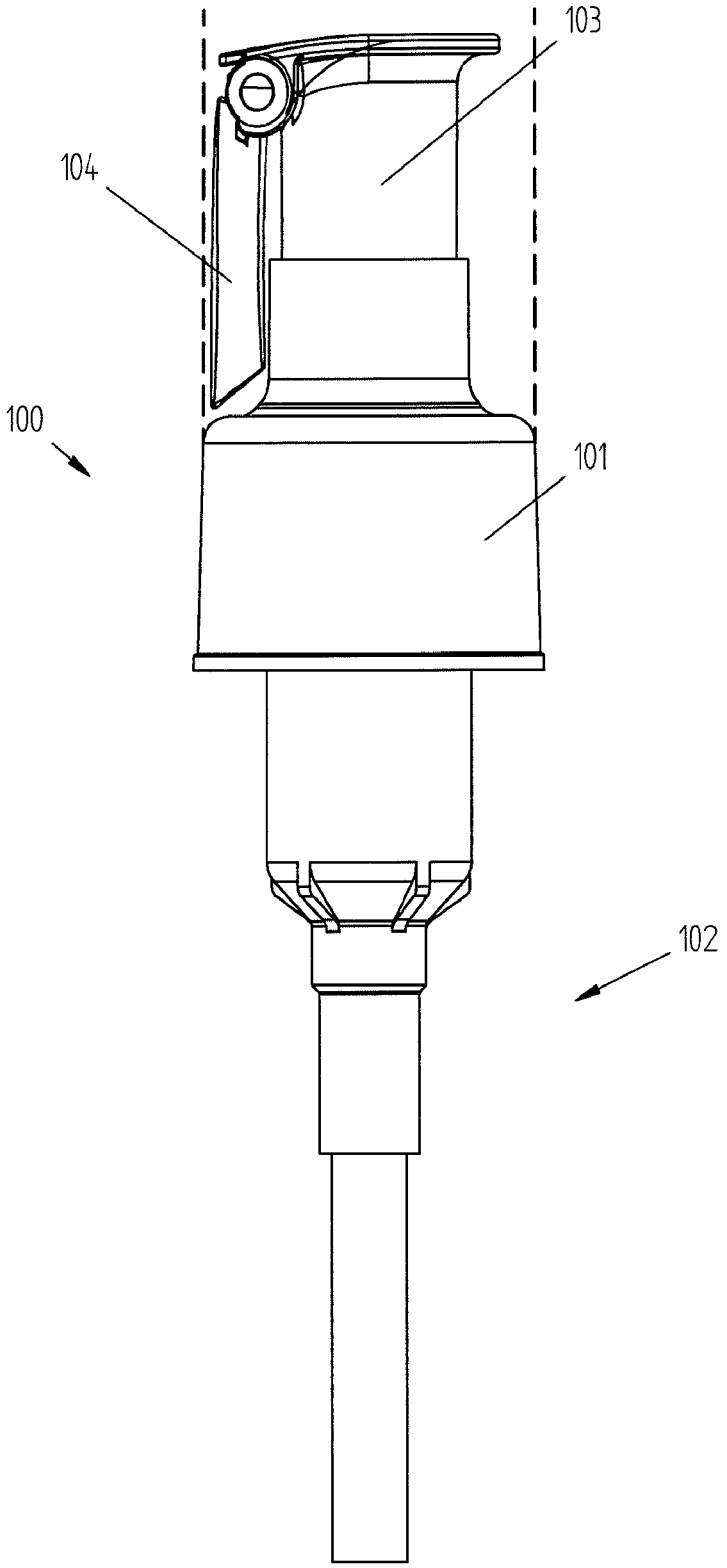
FIGS. 1 and 3 show side views of the dispensing device according to an embodiment of the present invention with the dispensing nozzle in the non-dispensing position.
Figure 2:
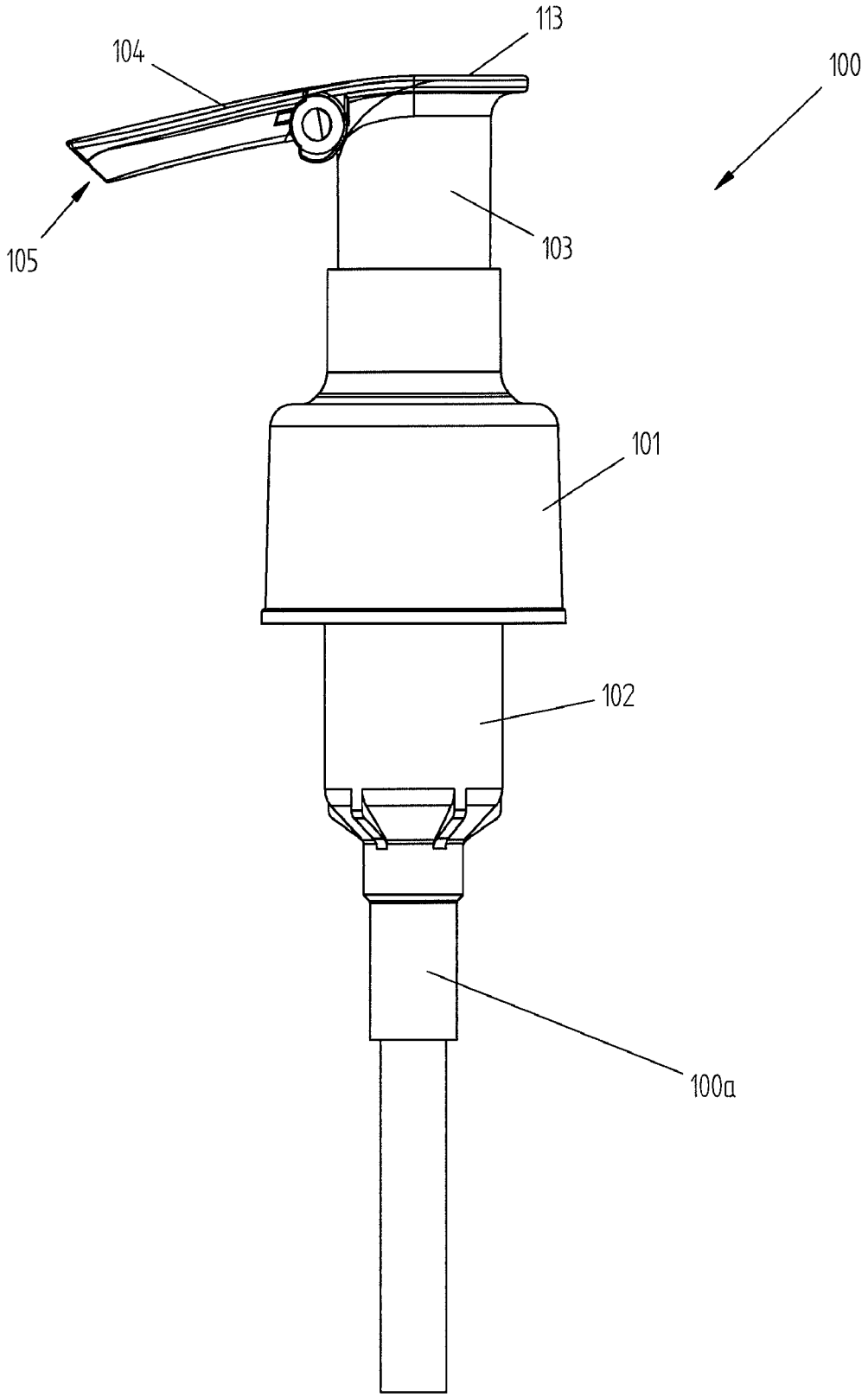
FIG. 2 shows a side view of the dispensing device according to an embodiment of the present invention with the dispensing nozzle in the dispensing position.
Figure 3:
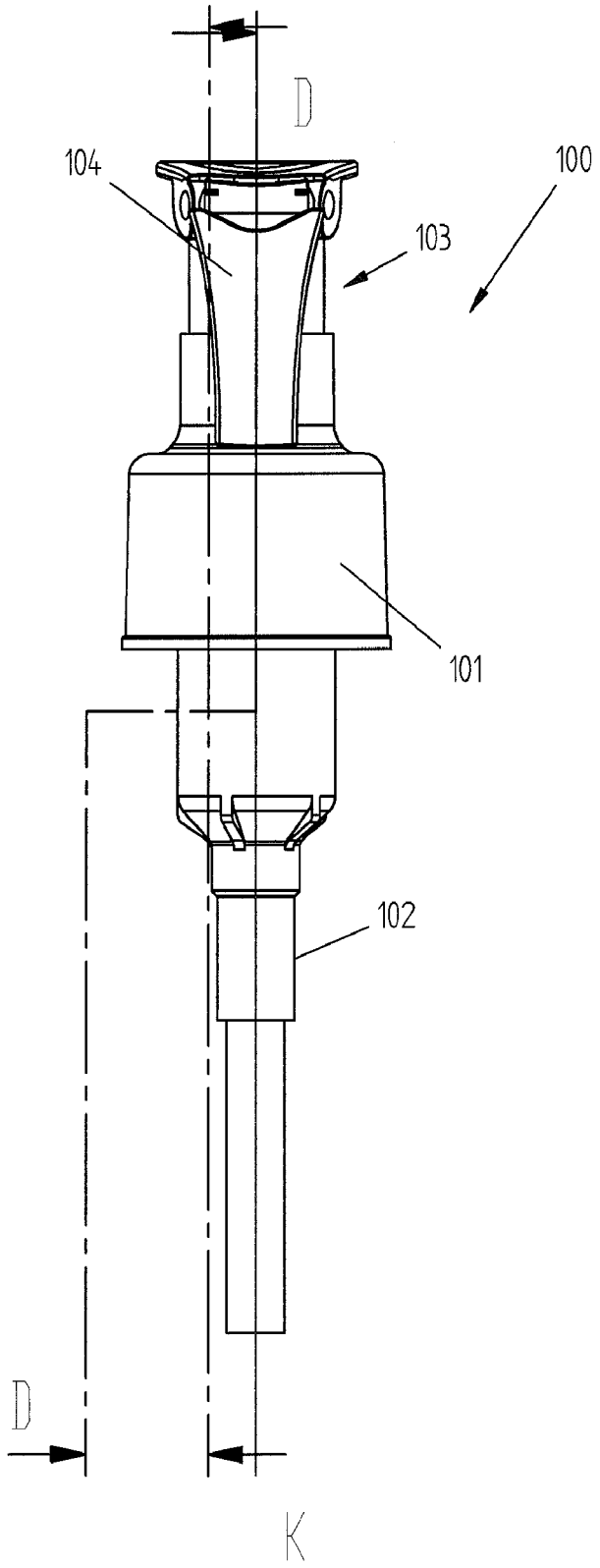
Figure 4:
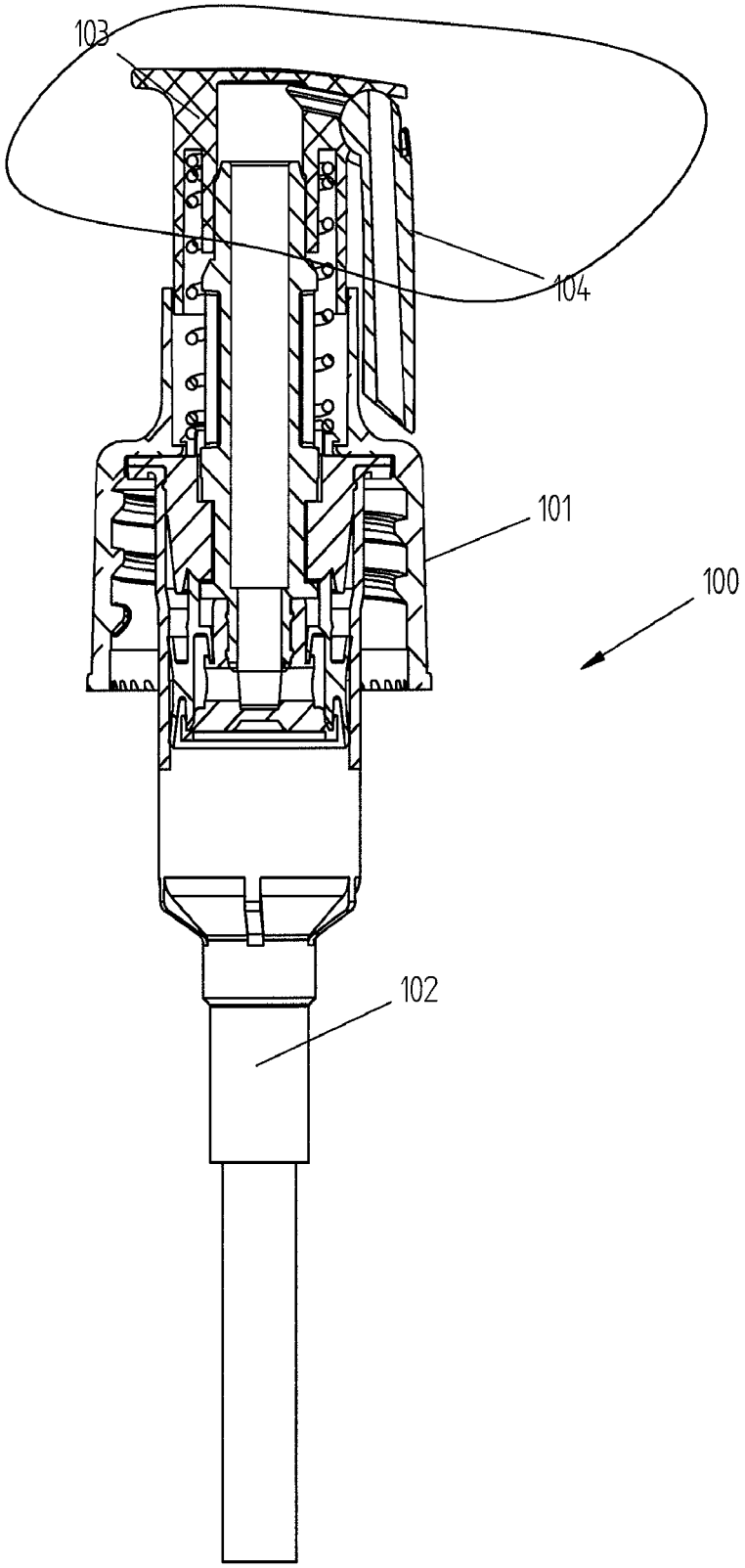
FIG. 4 shows a side sectional view of the dispensing device according to an embodiment of the present invention with the dispensing nozzle in the non-dispensing position.

With reference now in particular to FIGS. 1 and 2, it can be understood that the nozzle 104 is of the type that can be switched, in particular rotated, between a non-dispensing position illustrated in FIG. 1 and a dispensing position illustrated in FIG. 2. In the dispensing position, the dispensing duct 105 is in communication with the inside of the operating cap 103 (see also FIGS. 5 and 11), while on the contrary in the non-dispensing position (FIG. 1), the dispensing duct 105 is not in communication with the inside of the cap 103, on the contrary, the nozzle 104 closes the cap 103, thus preventing any communication between the inner space of the cap 103 (and thus of the device 100) and the outside.

According to the use or operating principles of the device 100, therefore, first the nozzle 104 is substantially switched from the non-dispensing position (FIG. 1) to the dispensing position (FIG. 2), then the cap 103 is pressed (once or several times, in the known manners) causing the fluid or liquid to be dispensed, and finally the nozzle 104 is possibly switched again from the dispensing position to the non-dispensing position.

It is also important to notice that, according to the embodiment of the device 100 illustrated in FIGS. 1 to 4, the dispensing nozzle 104 is positioned within the projection of the engagement means 101 (see the broken line in FIG. 1), with obvious advantages in terms of reduction of the overall dimensions of the device itself.

Figure 8:
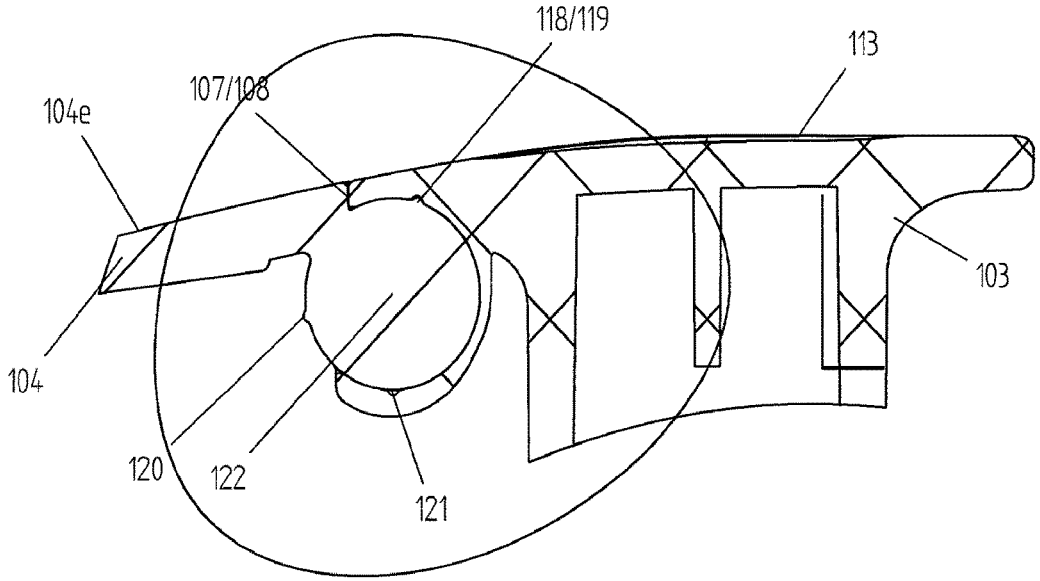
FIGS. 8 and 9 show side sectional views of the rotation device according to an embodiment of the present invention with the dispensing nozzle respectively in the dispensing and in the non-dispensing position.
Figure 9:
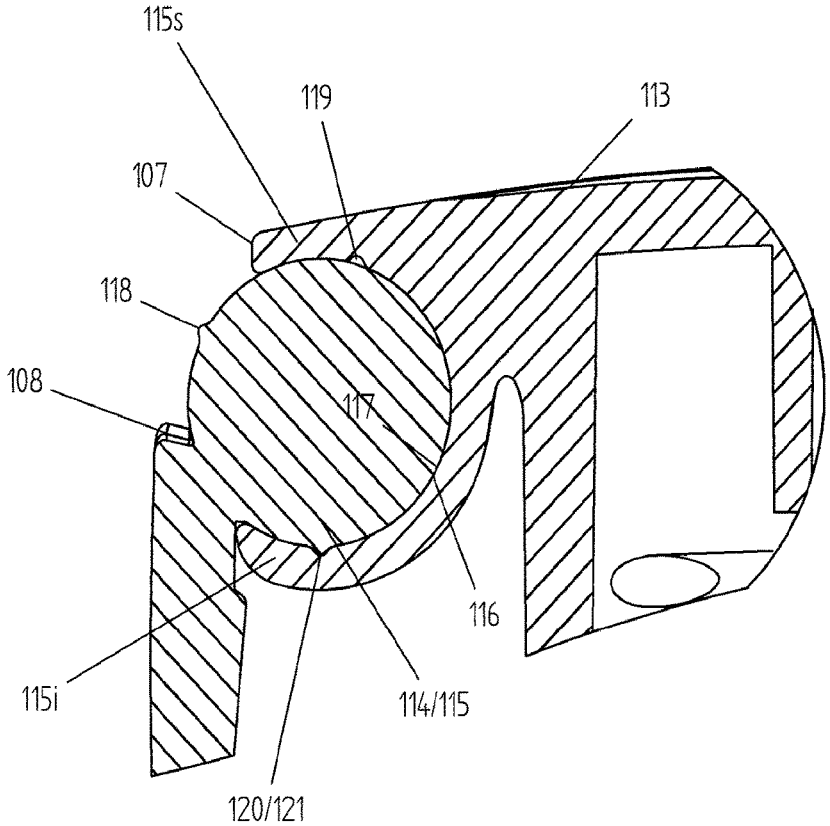

With reference to FIGS. 8 and 9, which respectively illustrate the nozzle 104 in the dispensing position and in the non-dispensing position, and in which component parts or characteristics of the device according to the present invention already described above with reference to other figures are identified by the same reference numbers, it is possible to observe that the nozzle 104 comprises a constraining portion 114 accommodated in a housing or constraining seat 115 in a matching shape, defined by the operating cap 103.

The shape of the constraining portion 114 and of the corresponding seat 115 can be selected according to the needs and/or circumstances; for example, it is possible to have a constraining portion 114 that is substantially cylindrical or even substantially spherical, wherein the shape of the seat 115 will match that of the constraining portion 114.

It is important to notice, however, that while the nozzle 104 is being switched the external surface 116 and the internal surface 117 respectively of the portion 114 and of the seat 115 slide with respect to each other (one on the other), thus allowing the nozzle 104 to be switched.

It is also equally important to notice that the mutual constraint between the portion 114 and the seat 115, and thus between the nozzle 104 and the cap 103, is guaranteed by the shape and size of the portion 114 and of the corresponding seat 115, respectively.

In fact, FIGS. 8 and 9 show, in particular, that the sizes of the portion 114 and of the seat 115 are such as to prevent the portion 114 from accidentally moving out of the seat 115, while on the contrary the portion 114 can be pressed into the seat 115, for example through the elastic deformation of the upper tab 115*s* and of the lower tab 115*i* that define the seat 115.

In particular, with reference to the rotation axis or centre 122 of the portion 114 (depending on whether the portion 114 is cylindrical or spherical), the constraint between the portion 114 and the seat 115 is guaranteed by the fact that the solid angle subtended by the portion of the internal surface 117 of the seat 115 in contact with the constraining portion 114 is larger than half the solid angle subtended by the external surface 116 of the portion 114, and preferably equal to or larger than ¾ of the surface 116.

For example, imagining a constraining portion 114 in a cylindrical shape and a seat 115 in a matching shape, the mutual constraint between the portion 114 and the seat 115 will be guaranteed by the fact that, with reference to the rotation axis 122 and according to a sectional view as that shown for example in FIG. 8, the angle subtended by the circular sector corresponding to the portion of the internal surface 117 of the seat 115 in contact with the portion 114 will be greater than 180° or, in other words, the diameter of the portion 114 will be greater than the clearance between the tabs 115*s* and 115*i*.

Again with reference to FIGS. 8 and 9, it is possible to observe that the dispensing nozzle 104 and the operating cap 103 respectively define a stop surface 108 and a stop surface 107 which, with the dispensing nozzle 104 in the dispensing position shown in FIG. 8, are arranged against each other and thus define the end-of-stroke position of the dispensing nozzle 104 (in the dispensing position). It is also important to notice the orientation of the two stop or contact surfaces 108 and 107, in particular of the stop or contact surface 108, wherein said surface 108 is substantially flat and lies on a plane crossed by the direction of extension of the nozzle 104, and thus of the dispensing duct 105, the directions of extension of the nozzle 104 and of the dispensing duct 105, respectively, being substantially parallel. The orientation of the surface 108 previously described above makes it possible to precisely define the end-of-stroke position of the dispensing nozzle 104, and thus its dispensing position, as well as the position of the dispensing duct 105, eliminating or at least reducing the risk of the same being partially clogged and therefore not perfectly communicating with the inside of the operating cap 103 when the nozzle 104 is in the dispensing position, in particular even in the case of excessive thrusting actions or loads applied to the dispensing nozzle 104 during switching from the non-dispensing position to the dispensing position. According to a preferred or advantageous embodiment, the surface 108 can in particular be oriented perpendicularly to the direction of extension of either the dispensing nozzle 104 or its dispensing duct 105, or both of them. Furthermore, it is also important to note that, with the dispensing nozzle 104 in the dispensing position, the upper surface 113 of the operating cap 103 (the surface intended to be pressed in order to operate the cap 103) and the external surface 104*e* of the nozzle 104 (extending from the surface 108) are positioned in such a way as to define a continuous surface, with considerable advantages in terms of aesthetic appearance of the device 100. Furthermore, the fact that the surfaces 104*e* and 113 define a continuous surface makes the operation of the cap 103 particularly comfortable.

A further characteristic of the dispensing device 100 according to the embodiment shown in FIGS. 8 and 9 is related to the fact that the constraining portion 114 comprises a plurality of projections 118, while the constraining seat 115 comprises a plurality of corresponding seats (lowered parts or grooves) 119. In particular, as shown in FIG. 8, with the dispensing nozzle 104 in the dispensing position, at least one projection 118 of the constraining portion 114 is inserted in a corresponding lowered part created in the constraining seat 115, thus avoiding or at least minimizing the risk of the dispensing nozzle 104 being spontaneously and undesirably switched from the dispensing position to the non-dispensing position. In the same way, with the dispensing nozzle 104 in the non-dispensing position (FIG. 9), at least one projection 118 is inserted in a corresponding lowered part 119, thus fixing the dispensing nozzle 104 in the non-dispensing position in a reliable manner, since, in fact, in order to switch the nozzle 104 from the non-dispensing position to the dispensing position, a minimum force is required which must be sufficient to overcome the mutual constraint between the projection 118 and the corresponding seat 119. For example, the mutual constraint between the projections 118 and the seats or lowered parts 119 can be of the type with elastic opposition, which in order to achieve the mutual constraint requires an elastic deformation of the projections 118 and/or of the corresponding seats 119. The type of constraint can obviously be selected, according to the needs and/or circumstances, based on the materials used to make the nozzle 104 and the cap 103 or at least its housing seat 115.

Figure 11:
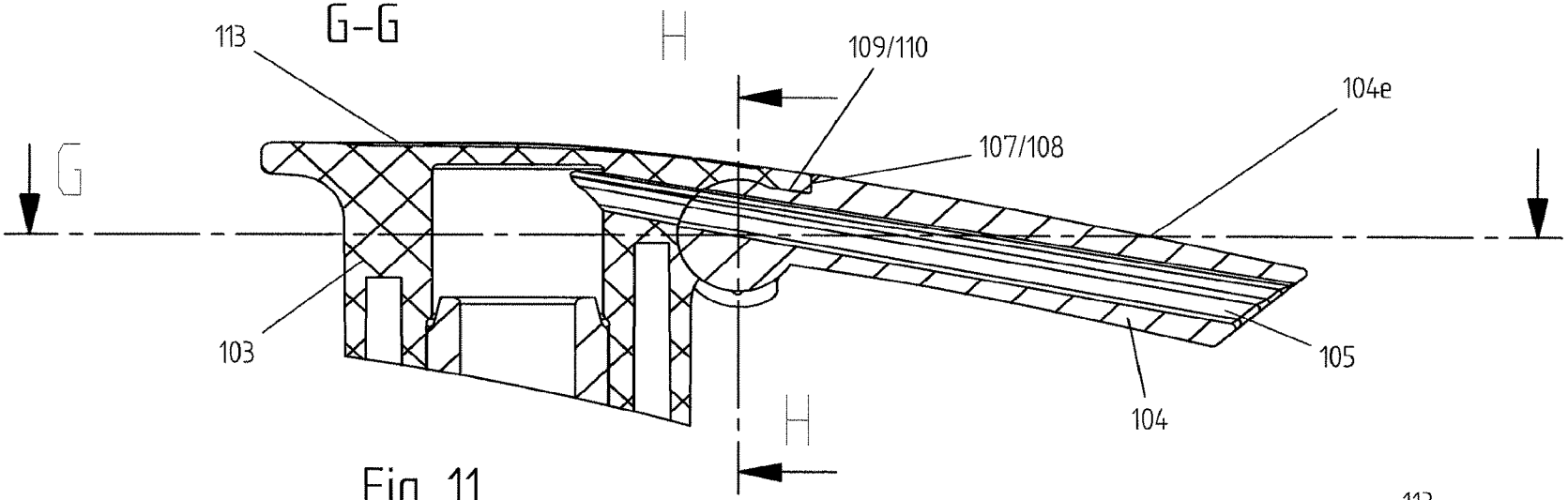
FIGS. 10 and 11 show side sectional views of the dispensing device according to an embodiment of the present invention with the dispensing nozzle in the dispensing position.

According to the embodiment represented in FIG. 11, in addition to the stop surfaces 108 and 107 described above with reference to FIGS. 8 and 9, the dispensing nozzle 104 and the operating cap 103 respectively define the stop surfaces 110 and 109, which when the dispensing nozzle 104 is in the dispensing position of FIG. 11 are arranged against each other and thus contribute to defining the end-of-stroke position of the dispensing nozzle 104 (in the dispensing position).

It is also important to observe the orientation of the two stop or contact surfaces 110 and 109, in particular of the stop or contact surface 110, wherein in this case said surface 110 (again substantially flat) lies on a plane that is not crossed by the direction of extension of the nozzle 104, and thus is not crossed by the direction of extension of the dispensing duct 105, either.

Also in this case, the orientation of the surface 110 as described above makes it possible to precisely define the end-of-stroke position of the dispensing nozzle 104, and thus its dispensing position, as well as the position of the dispensing duct 105, also in this case eliminating or at least reducing the risk of the same being partially obstructed or in any case not perfectly in communication with the inside of the operating cap 103 when the nozzle 104 is in the dispensing position.

According to a preferred or advantageous embodiment, the surface 110 can in particular be oriented so that it is parallel to the direction of extension of either the dispensing nozzle 104 or its dispensing duct 105, or both of them, and thus substantially perpendicular to the surface 108.

As illustrated in FIG. 11, the stop or contact surface 110 extends from the surface 108 according to a predefined orientation, in such a way as to define a stop or contact seat 112; in the same way, the surface 109 extends from the surface 107 according to a predefined orientation, in such a way as to define a stop or contact projection 111. As shown in particular in FIG. 11, with the dispensing nozzle in the dispensing position the stop or contact projection 111 of the cap 103 is housed in the stop or contact seat 112 of the dispensing nozzle 104.

As shown in FIG. 11, said stop projection 111 and said stop seat 112 can in particular be shaped in such a way that, also in this case, the surface 113 of the operating cap 103 and the external surface 104*e* of the dispensing nozzle define a continuous surface.

It should however be noted that, even if the stop or contact surfaces 109 and 110 have been described in combination with the surfaces 107 and 108, according to the present invention it is possible to develop an embodiment in which the dispensing nozzle 104 and the operating cap 103 respectively comprise only the surface 110 and the surface 109.

Figure 10:
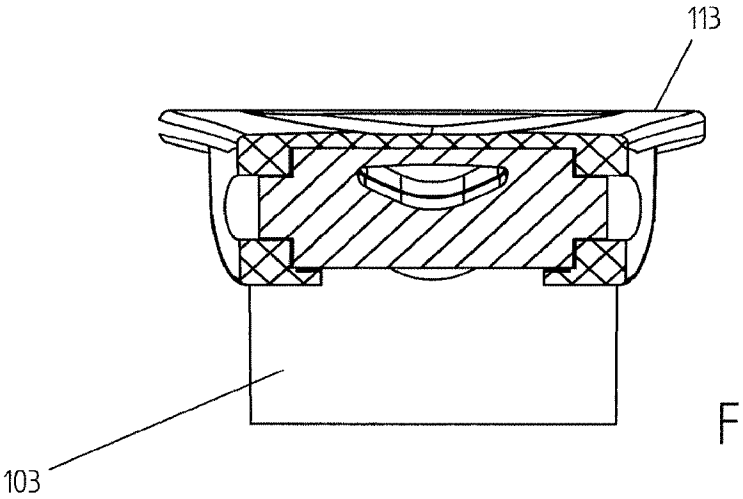

Further details of the dispensing device according to the present invention are described below with reference to FIGS. 5, 6 and 10, in which component parts or characteristics of the device according to the present invention already described above with reference to other figures are identified by the same reference numbers.

Figure 5:
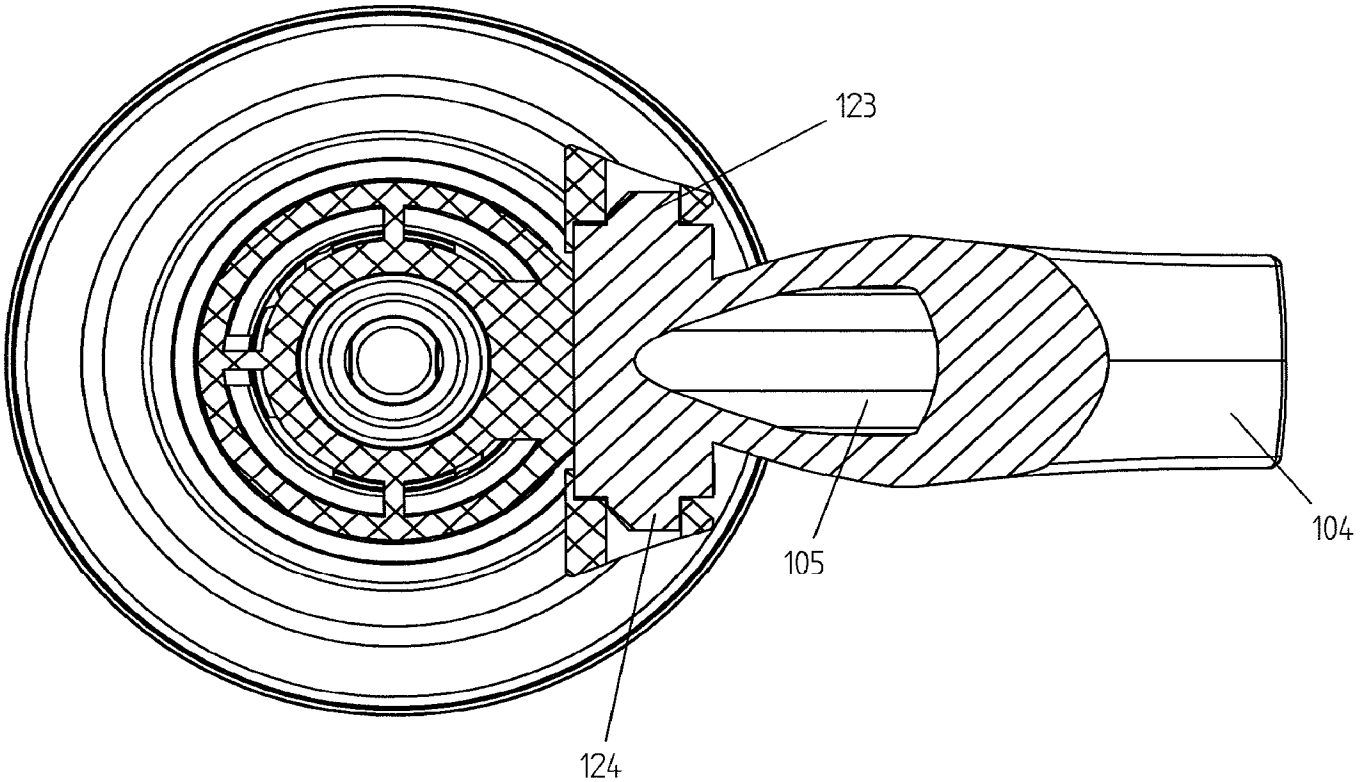
FIG. 5 shows a top sectional view of the dispensing device according to an embodiment of the present invention with the dispensing nozzle in the dispensing position.
Figure 7:
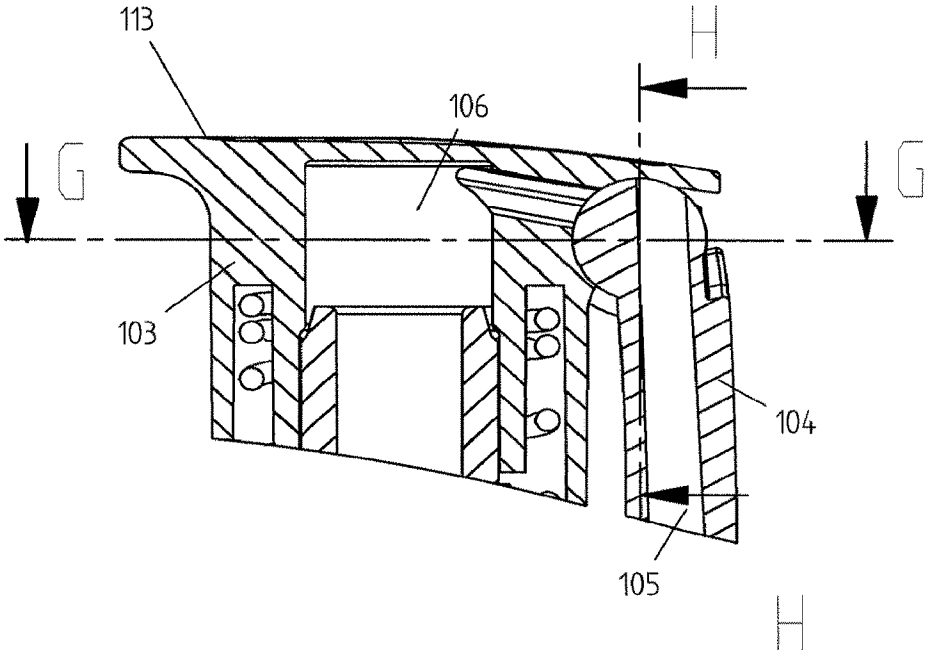
FIGS. 6 and 7 show side sectional views of the dispensing device according to an embodiment of the present invention with the dispensing nozzle in the non-dispensing position.
Figure 6:
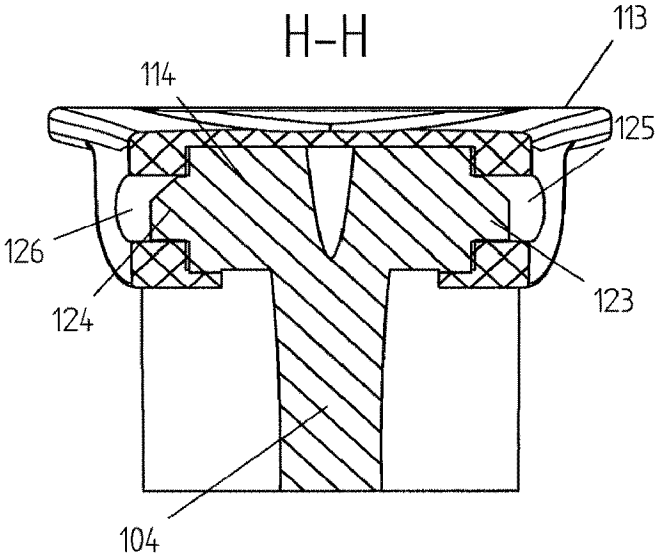

It is possible to observe, in particular in FIG. 5, that the constraining portion 114 (in this case substantially cylindrical) of the nozzle 104 comprises a constraining pin defined by two projections 123 and 124 that extend on opposite sides of the portion 114, substantially parallel to the rotation axis of the portion 114.

The two projections 123 and 124 are respectively inserted in two corresponding seats 125 and 126 defined by the housing seat 115 of the operating cap 103.

This solution makes it possible to increase the stability of the device as a whole, in particular the reliability of the mutual constraint between the portion 114 of the nozzle 104 and the seat 115 of the cap 103.

In fact, imagining that with the dispensing nozzle in the dispensing position (FIG. 8) a rotary thrusting movement is exerted on the nozzle 104 (in the rotation direction selected to switch from the non-dispensing position to the dispensing position, and thus clockwise with reference to FIG. 8), the constraining pins 123 and 124, in combination with the respective seats 125 and 126, avoid the risk of the constraining portion 114 moving out of the corresponding seat 115, even in case of deformation of the seat 115 itself and/or of the portion 114.

Obviously, according to the present invention, the constraining pins 123 and 124 can be defined by the seat 115, wherein in this case the corresponding seats 125 and 126 will be defined by the constraining seat 115 of the nozzle 104.

Obviously, according to the present invention, the constraining pins 123 and 124, as well as the corresponding seats 125 and 126, can be provided in case of a seat 115 and a portion 114 in any shape.

According to the further embodiment represented in FIGS. 12 to 15, the operating cap 103 is shaped in such a way as to define, on each one of the opposite sides of the seat 115, a cam-shaped surface 130 which in turn, in a side view (FIGS. 13 to 15), is substantially defined by a protruding part or projection.

Figure 15:
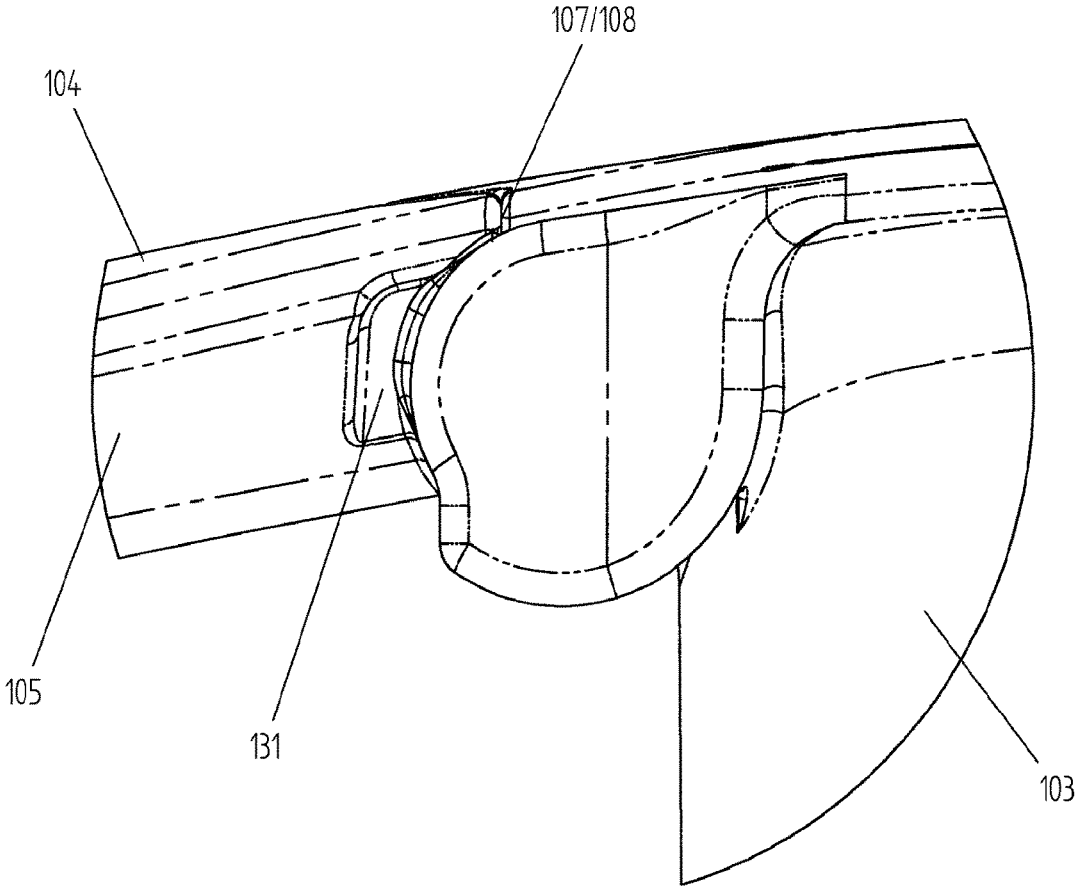

In its turn, the dispensing nozzle 104 is shaped in such a way as to define two seats 131, each placed at the level of a projection with cam-shaped surface 130 of the operating cap 103. The cam-shaped surfaces 130 and the respective seats 131 have the function to provide further stability to the system made up of the cap 103 and the nozzle 104, both in the non-dispensing position (FIG. 13) and in the dispensing position (FIG. 15).

In fact, observing the figures it is possible to understand that, while the nozzle 104 is being switched from the non-dispensing position to the dispensing position, the nozzle 103, in particular each of the two portions of the nozzle 103 defining a seat 131 (and each defining a stop or contact surface 107), needs to move beyond the corresponding surface 131 due to elastic deformation (with more or less difficulty depending on the shape of the surfaces 131). In particular, FIG. 14 should be observed, which shows the nozzle 104 midway between the dispensing and the non-dispensing position.

In the dispensing position (FIG. 15), each one of the projections with cam-shaped surface 130 is housed in the corresponding seat 131, wherein in the non-dispensing position (FIG. 13) the projections and the respective cam-shaped surfaces 130 are positioned outside of the corresponding seats 131.

As an alternative or in addition to the solution just described above, always in the context of the present invention, in relation to tightness the solution represented in FIG. 12 can be provided.

In FIG. 12, in fact, each of the reference numbers 150 and 151 identifies a sealing edge protruding from the operating cap 103 towards the inside of the constraining seat 115.

Figure 14:
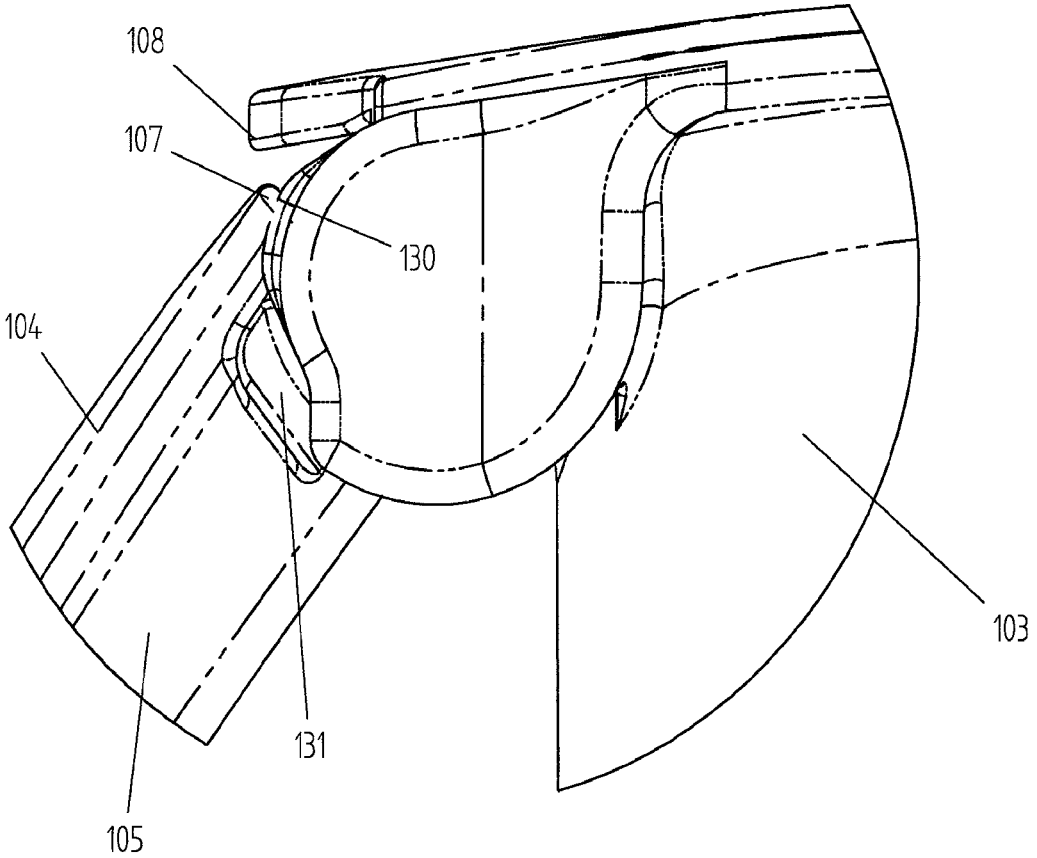

In particular, of the two sealing edges 150 and 151, the (internal) edge 150 ensures tightness with the dispensing nozzle both in the dispensing and in the non-dispensing position (FIGS. 17 and 16), while the (external) edge 151 ensures tightness with the nozzle 104 in an intermediate position, as shown, for example, in FIG. 14.

More particularly, the mutual action of the sealing edges 150, 151 against the body 114 of the nozzle 104 serves to avoid the risk of fluid or liquid leakages.

In particular, with the nozzle 104 in the non-dispensing position (and thus with the inner space of the cap closed towards the outside by the constraining portion 114), the sealing edges 151, 150 prevent any fluid or liquid leakages through the interstice located between the constraining portion 114 and the seat 115.

In the same way, with the nozzle 104 in the dispensing position, and thus with the duct 105 in communication with the inside of the cap 103, the sealing edge 150 allows the fluid or liquid to flow out only through the duct 105, but not through the interstice located between the portion 114 and the seat 115.

It has thus been shown, by means of the previous detailed description of the embodiments of the present invention illustrated in the drawings, that the present invention makes it possible to achieve the set objects and to overcome the drawbacks that are typical of the dispensing devices carried out according to the known art.

The present invention, in fact, makes it possible to avoid or at least minimize the risk of the nozzle accidentally coming off, guarantees the reliable and stable positioning of the switching nozzle both in the dispensing and in the non-dispensing position, guarantees the tightness of the device avoiding fluid or liquid leakages, in particular at the level of the mutual coupling point between the dispensing nozzle and the operating cap.

The present invention furthermore makes it possible to limit the overall dimensions of the device itself and to give the dispensing device a pleasant appearance and shape, as well as to provide a device in which the dispensing nozzle can be switched in a simple and immediate manner, and in which the component parts can be made and assembled according to equally simple and immediate methods, and therefore at limited costs.

Even though the present invention has been illustrated above through a detailed description of its embodiments represented in the drawings, the general scope of the present invention is defined by the claims.

The invention claimed is:

1. A closure and nozzle assembly for use with a dispensing container, the assembly comprising:

a cap defining a dispensing duct, said cap having a nozzle seat with curved sealing edges, at least one camming surface, and at least one groove disposed along a lower facing of the nozzle seat, a rotatable nozzle having an outlet end and a cylindrical- or spherical-shaped end received within the nozzle seat so that the cylindrical- or spherical-shaped end is fluidically sealed to the cap, said rotatable nozzle further defining an internal duct and having a camming seat formed on an external surface of the rotatable nozzle and a corresponding projection formed on a top facing of the rotatable nozzle;

wherein the corresponding projection is received in the at least one groove to unwanted prevent rotation of the rotatable nozzle relative to the nozzle seat;

wherein the internal duct forms a sealed flow path with the curved sealing edges when the rotatable nozzle is in a dispensing position;

wherein an outer surface of the cylindrical- or spherical-shaped end abuts the curved sealing edges and seals the dispensing duct when the rotatable nozzle is in a folded position;

wherein a plurality of stopper surfaces are spaced apart on the nozzle seat and cooperating upper and lower stopper facings on the rotatable nozzle so that rotation of the rotatable nozzle between the dispensing and folded positions is constrained by one of the stopper surfaces coming into contact with one of the upper and lower facings; and wherein the at least one camming surface abuts an edge of the camming seat when the rotatable nozzle is in a dispensing position to constrain rotatory movement of the rotatable nozzle between the dispensing position and the folded position.

2. The assembly of claim 1 wherein a pair of corresponding projections are formed and spaced apart on opposing lateral edges of the rotatable nozzle so that at least one of the pair of corresponding projections is received within the groove irrespective of whether the rotatable nozzle is in the folded or dispensing position.

3. The assembly of claim 2 wherein the pair of projections define a constraining pin portion on the cylindrical-shaped end of the rotatable nozzle, said constraining pin portion oriented on an axis that is generally orthogonal to the dispensing duct.

4. A closure and nozzle assembly for use with a dispensing container, the assembly comprising:

a cap defining a dispensing duct, said cap having a nozzle seat with curved sealing edges and a camming surface, a rotatable nozzle having a camming seat, an outlet end and a spherical-shaped end received within the nozzle seat so that the spherical-shaped end is fluidically sealed to the cap, said rotatable nozzle further defining an internal duct;

wherein a cooperating projection and groove are provided on interfacing surfaces of the nozzle seat and the rotatable nozzle, said cooperating projection and groove preventing unwanted movement of the rotatable nozzle relative to the nozzle seat;

wherein the internal duct forms a sealed flow path between the dispensing duct and the outlet end when the rotatable nozzle is in a dispensing position;

wherein an outer surface of the spherical-shaped end blocks and seals the dispensing duct when the rotatable nozzle is in a folded position; and wherein the camming surface and the camming seat cooperate constrain rotatory movement of the rotatable nozzle between the dispensing position and the folded position and to facilitate separation and movement of the rotatable nozzle from the nozzle seat while the rotatable nozzle is being rotated relative to the nozzle seat between the dispensing position and the folded position.

* * * * *